United States Patent [19]

Perrot

[11] Patent Number: 5,010,532

[45] Date of Patent: Apr. 23, 1991

[54] ELECTRONIC WATCH HAVING AN OPENING FOR RECEIVING A BATTERY AND A COVER CLOSING THIS OPENING, AND METHOD OF MASS-PRODUCING THIS WATCH

[75] Inventor: Friedrich Perrot, Lengnau, Switzerland

[73] Assignee: ETA SA Fabriques d'Ebauches, Grenchen, Switzerland

[21] Appl. No.: 371,942

[22] Filed: Jun. 27, 1989

[30] Foreign Application Priority Data

Jun. 30, 1988 [CH] Switzerland ..... 02494/88

[51] Int. Cl.[5] ..... G04B 37/00

[52] U.S. Cl. ..... 368/88; 368/309

[58] Field of Search ..... 368/88, 203–204, 368/309–310; 156/250, 261; 29/177, 469.5; 429/96, 98, 100

[56] References Cited

U.S. PATENT DOCUMENTS

| | | | |
|---|---|---|---|
| 3,608,304 | 9/1971 | Schaad | 368/204 |
| 3,783,604 | 1/1974 | Florent et al. | 368/204 |
| 4,166,359 | 9/1979 | Domokos | 368/309 |
| 4,182,020 | 1/1980 | Molloy et al. | 29/177 |

FOREIGN PATENT DOCUMENTS

| | | |
|---|---|---|
| 2000544 | 7/1970 | Fed. Rep. of Germany . |
| 54-104370 | 8/1979 | Japan . |
| 54-136869 | 10/1979 | Japan . |
| 3449/67 | 10/1969 | Switzerland . |
| 613072 | 8/1979 | Switzerland . |
| 650121 | 3/1980 | Switzerland . |
| 2057167 | 3/1981 | United Kingdom . |
| 2178561 | 2/1987 | United Kingdom . |

OTHER PUBLICATIONS

British Patent Documents No. 2,178,561 and No. 2,057,167; Japanese Patent Documents No. 54–104,370 and No. 54–136,869; German Patent Document No. 2,000,544; and Swiss Patent Documents No. 650,121 and No. 613,072.

*Primary Examiner*—Vit W. Miska

*Attorney, Agent, or Firm*—Pollock, Vande Sande & Priddy

[57] ABSTRACT

A removable cover (10) for closing an opening (15) of a battery housing in an electronic watch having an armature (7) which is a flat metal disc with central and peripheral openings in which a molded cylindrical packing member (9) is anchored. The back (14) of the watch case is formed with a circular opening (15) with a particular profile suited to the diameter of the packing member (9). The latter, by radial compression, secures the cover and provides fluid-tightness. All of the operations for mass-producing the cover (10) and fitting it are carried out mechanically, without manual intervention, and are automated.

28 Claims, 3 Drawing Sheets

ELECTRONIC WATCH HAVING AN OPENING FOR RECEIVING A BATTERY AND A COVER CLOSING THIS OPENING, AND METHOD OF MASS-PRODUCING THIS WATCH

BACKGROUND OF THE INVENTION

It is known that some electronic watches are designed so that when the power source is exhausted, the user has the option of himself changing it or having it changed easily. In such watches there is often provided, in an external part of the watch, usually the back of the case, an opening facing the battery housing and this opening is fluid-tightly closed by a removable cover. However, production of the cover and fitting it during final assembly of the watch constitute additional manufacturing operations compared to watches where exchange of the battery requires removal of the back. It is consequently important to simplify these operations and rationalise them as far as possible.

The following publications describe several examples of watches provided with such a cover: GB 2 178 561, JP 54-104 370, JP 54-136 869, GB 2 057 167, DE 2 000 544 and CH 650 121. In each of these constructions, the cover is provided with an annular sealing joint or packing member (O-ring) which must exactly and carefully be placed in position each time the cover is closed. Also, the cost of such packing members is not negligible. In publication CH 613 072 it is proposed to secure the cover in fluid-tight manner by using a piece of adhesive tape.

None of these known systems enables mating and fitting of the cover to be automated efficiently and the present invention aims to remedy this drawback by improving production of electronic watches fitted with a removable cover for changing the battery.

SUMMARY OF THE INVENTION

For this purpose, a first object of the invention is to provide an electronic watch comprising internal parts which define a battery housing, at least one external part having an opening for inserting a battery in its housing and a removable cover closing said opening, the cover comprising an inner portion engaging in the opening and an outer portion, and which principally is characterized by the fact that the cover comprises a rigid armature which is at least partially embedded by being molded in a flexible, elastic material, said armature being situated at least partly in the outer portion of the cover and bearing at least indirectly and locally against the external part of the watch around said opening; that said external part of the watch and the packing member of the cover have respective annular surfaces in contact with one another; and that said packing member of the cover is arranged so that its annular surface is pressed against that of the external part of the watch to provide fluid-tight closure of said opening.

A further object of the invention is to provide a method of mass-producing such a watch, characterized in that the cover is formed in a series of successive operations including operations of forming the armature and at least one operation for molding the packing member over the armature, and in that a step of automatically fitting the cover in/on the opening of the watch is associated with production of the cover.

An embodiment of carrying out the mass-production method according to the second object of the invention and various embodiments of the cover for equipping watches obtained by this method will now be described, by way of example.

BRIEF DESCRIPTION OF DRAWINGS

In the accompanying drawings

DETAILED DESCRIPTION

Figure 1C:
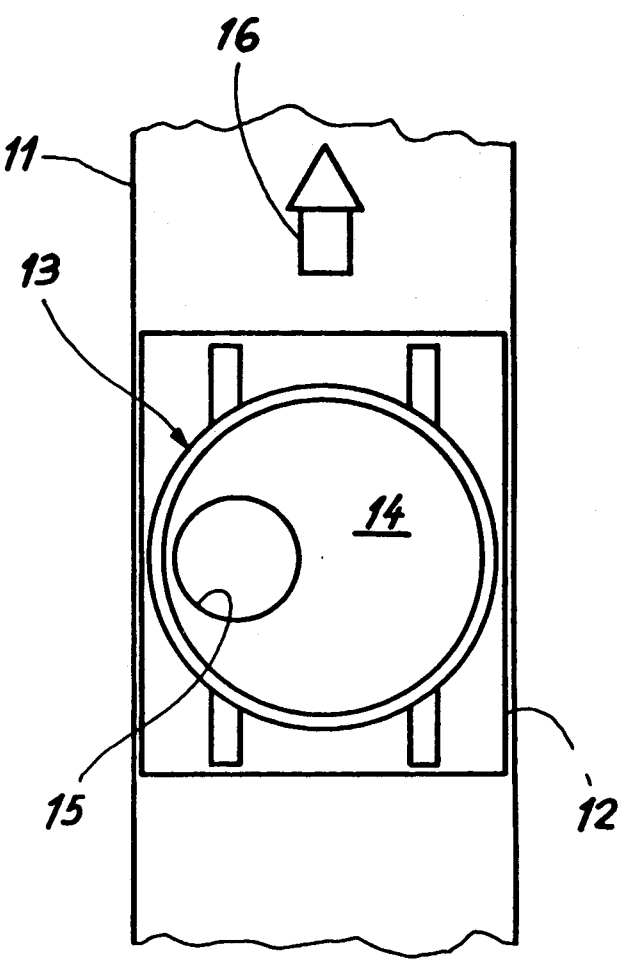
FIGS. 1*a*, 1*b*, and 1*c* are schematic plan views illustrating successive steps of the production of a cover and fitting it onto a watch.

To fully automate the production of a cover, a thin metal strip 1 for example of stainless steel is firstly guided and driven step-by-step in the direction of arrow 2, so as to progressively move through a multi-workstation machining apparatus. These workstations are designated in FIG. 1*a* by references I, II and III. Although three workstations are shown in the described example, it would also be possible to provide intermediate workstations for carrying out certain operations or additional workstations for carrying out other operations than those that will be described.

Step I consists in the stamping of openings 3 and 4 for guiding and driving the strip 1.

During step II, a series of circular openings 5, for anchoring the packing member, are stamped in the central part of the strip, one of these openings 5 being surrounded by others.

Step III then includes stamping in the strip 1 of four openings 6 in the form of arcuate slots centered about the central opening 5. The inner edge of slots 6 defines the periphery of the cover's armature. This armature, designated by 7, is therefore connected to the strip 1 only by four tabs 8 which will be cut during fitting of the finished cover, as will be seen later.

Figure 1A:
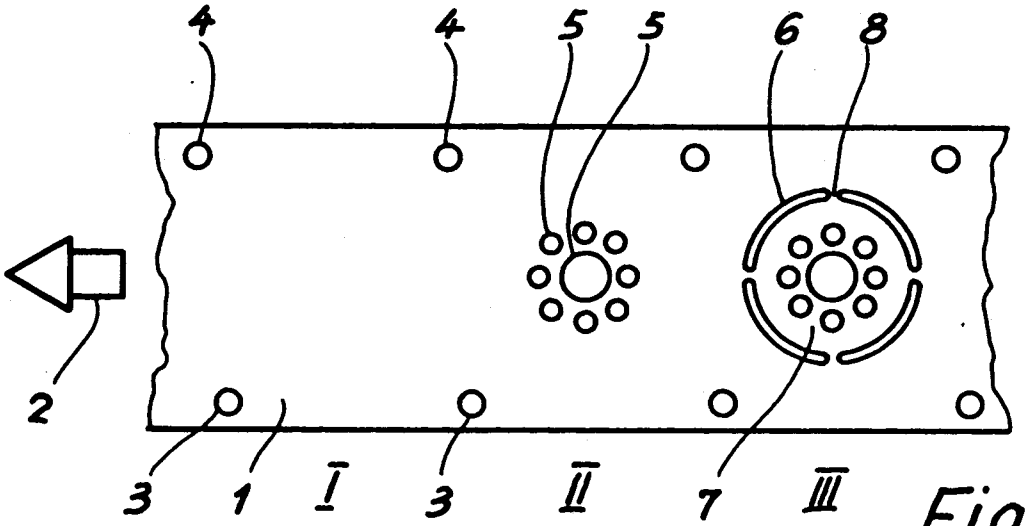
Figure 1B:
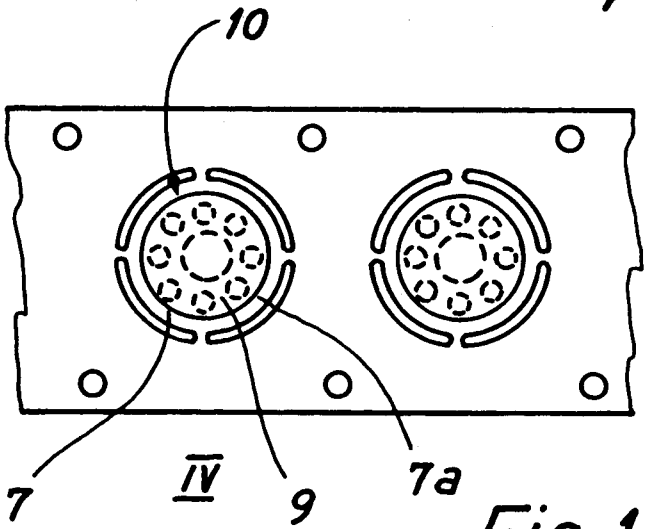

At the output of the machining apparatus to which workstations I, II and III belong, the strip 1 is coiled and conveyed to an injection molding unit where operation IV, schematically shown in FIG. 1*b*, is carried out, namely two parts of a mold are applied on either side of the strip 1, coaxially around the pre-formed armature 7, and a mass 9 of thermoplastics material having properties that will be discussed below is injected in the mold in such a manner as to form the cover's packing member anchored to the armature 7 by casting in the openings 5. The packing member 9 is generally of cylindrical shape. Its diameter is slightly less than that of the inner edges of the slots 6 whereby the periphery of the armature 7 forms a continuous projecting rim 7*a* which, during the following step, limits the penetration of the cover 10, formed by the armature 7 and the packing member 9, in the opening of the external part of a watch that it must obturate.

The unit in which operation IV is carried out also functions automatically. If required, it could include a multi-chamber mold or several molds operating simultaneously at several of the perforated regions of the strip 1 produced during the previous steps.

The last operation for the production of the covers takes place in a terminal workstation V, after molding. The strip 1 is acted upon by a punch (not shown) which cuts the tabs 8 to separate the armatures 7 from the strip 1.

Each finished cover is then taken up, by suction or clamping, by a conveyor arm (also not shown) and is brought into a well-defined position above a guide and conveying path 11, for example a slide, along which travel supports 12 on each of which is placed a finished watch 13 that comprises, as shown in FIG. 1*c*, the case member 14 formed as a back-cum-middle with a circular opening 15 giving access to a battery housing arranged in the internal parts of the watch. Apart from the fact that it must have an external part 14, with the opening 15, and internal parts defining a housing for a replaceable battery, the electronic watch 13 can be of any type.

The finished cover 10 is thus precisely located above the opening 15 of a watch 13 that has also been conveyed to said workstation with its back facing up. It is supported by the conveyor arm which is arranged in such a manner as to engage the lower portion of the packing member 9 in the opening 15. The projecting rim 7*a* of the armature 7 comes to bear against the outer surface of the back-cum-middle 14 so that a battery previously inserted in its housing is embedded in a fluid-tight manner. When the battery has to be changed, to extract the battery it suffices to insert a blade under the visible rim of the armature 7 to open the cover 10. The latter may later be put back in place very simply because the cover itself provides fluid-tight closure of the opening 15.

As is also shown in FIG. 1C, the supports 12 carrying watches 13 fitted with covers 10 are delivered in the direction of arrow 16.

FIGS. 2 to 8 show watches equipped with different embodiments of covers produced and fitted in automatic equipment of the type shown in FIG. 1.

Figure 2:
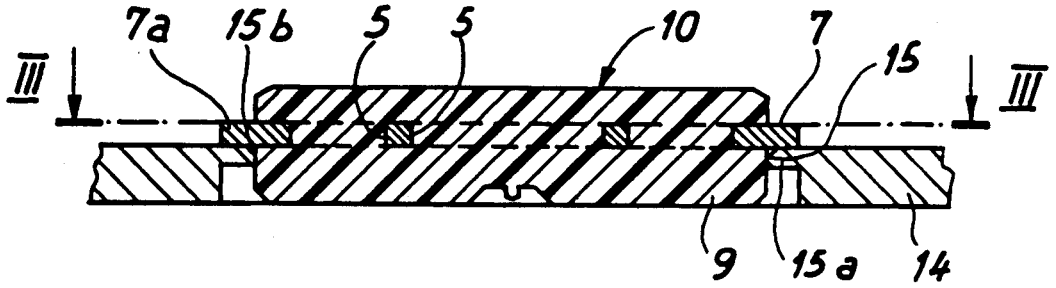
FIGS. 2 and 3 are partial cross-sectional views, to an enlarged scale, of a first embodiment of the invention taken respectively along a vertical plane and along line III—III of FIG. 2.
Figure 3:
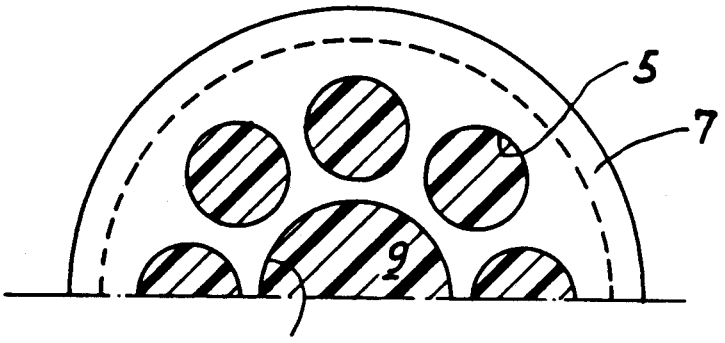

The cover 10 with its armature 7, packing member 9 and rim 7*a* can be seen in FIGS. 2 and 3. The periphery of the opening 15 of the case member 14 has a shouldered profile formed of two cylindrical parts of different diameters defining therebetween a flat annular shoulder 15*a*. This specific shape of the opening's periphery is designed to produce a slight swelling of the material of the packing member behind the shoulder 15*a* after the cover has been fitted. This swelling, which has not been illustrated in FIG. 2, assists holding the cover 10 in place.

FIG. 2 shows however that the opening 15 has a slightly bevelled or rounded outer edge 15*b* which eases engagement therein of the cover 10 and, most importantly, prevents the packing member from being cut against the armature 7 during fitting.

Figure 4:
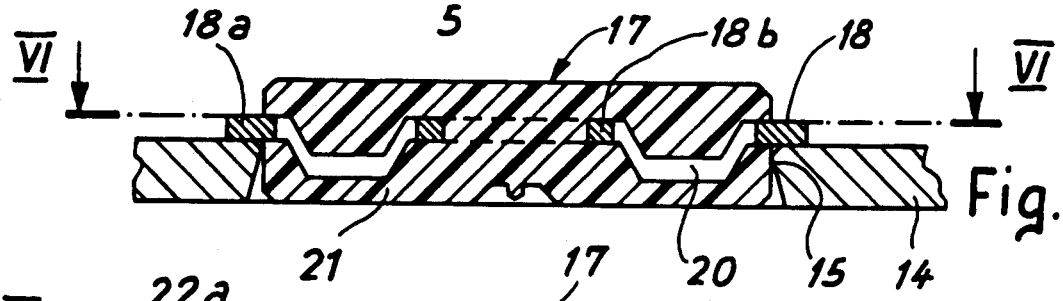
FIGS. 4 and 5 are views, similar to FIG. 2, of a second embodiment and a third embodiment.
Figure 6:
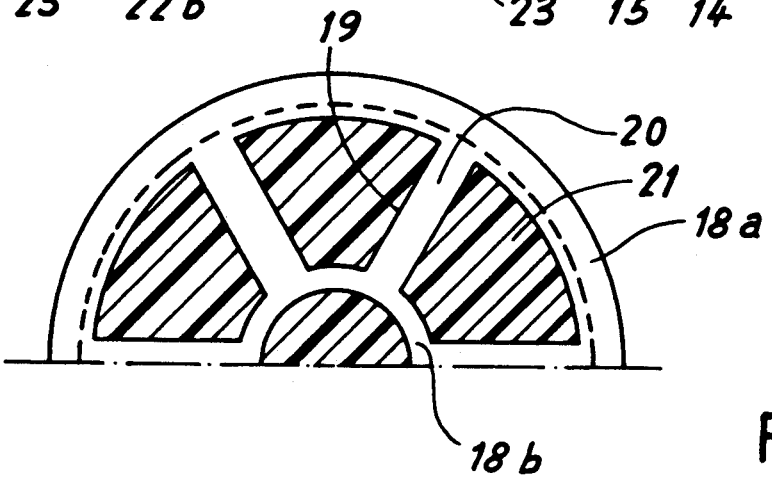
FIG. 6 is a view, similar to FIG. 3, of the second and third embodiments.

FIGS. 4 and 6 show a cover 17 provided with an armature 18 having a shape different to the armature 7. Instead of circular openings 5 arranged around the center of the armature, the openings 19 of FIG. 6 are in the form of sectors of a crown separated by radial arms 20 of rectangular shape. Production of the armature involves one or several stamping or cutting operations. The armature 18 as shown in FIGS. 4 and 6 comprises an external ring 18*a* and an internal ring 18*b* to which the arms 20 are connected. These arms are furthermore stamped in stirrup shape (see FIG. 4) so that their median part is situated in and rigidifies the axially inner portion of the packing member 21.

Figure 5:
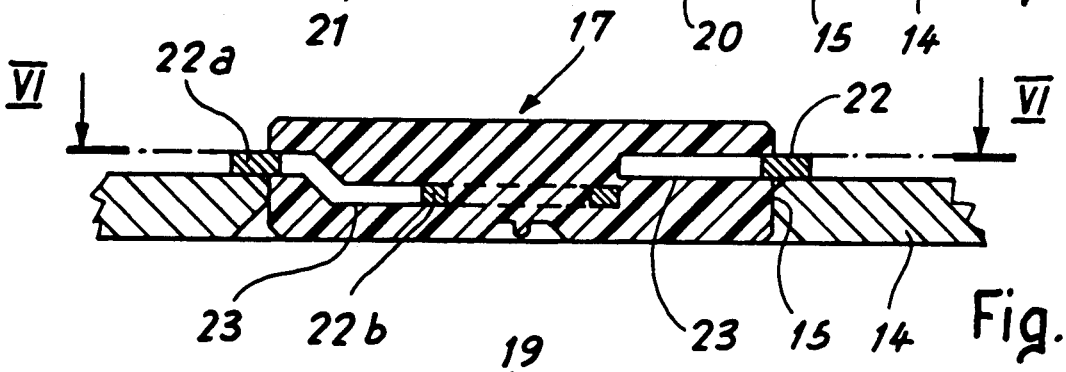

In the embodiment of FIG. 5, the armature 22 and the packing member have the same shapes in plan view as in FIG. 6. However, some of the radial arms 23 have undergone a bending operation whereas the other arms were cut along the external edge of the inner crown 22*b*. The inner ring 22*b* is thus offset to a lower level than the external ring 22*a*. Moreover, the arms 23 which have been sectioned from the inner ring 22*b* extend horizontally into the mass of the packing member 21 (right hand part of FIG. 5).

Furthermore, apart from the fact that the outer edge of the opening 15 is once again slightly bevelled or rounded, the profile of the periphery of the opening of the case member 14 in the embodiment of FIG. 4 can be considered to be frusto-conical over the entire thickness of this member, whereas in the embodiment of FIG. 5 this profile has a first, axially-outer cylindrical portion which engages with suitable tightness the periphery of the packing member 21 and a second, axially-inner frusto-conical portion. In both of these embodiments, the conicity of the opening 15 obviously tapers from the inside to the outside of the case member 14, the angle of the slope ranging from say 5° to 45° for example.

In the embodiments of FIGS. 2 to 6, the axially-inner portion of the cover's packing member that is engaged in the opening of the case member 14 has its diameter set relative to the diameter of the narrowest part of the opening to provide a slight compression. This compression simultaneously secures the cover and provides its fluid-tightness.

For best results, the properties of the plastics material used for the packing member should be carefully selected. Extensive tests have shown that a thermoplastic elastomer produced under the name "Hytrel TM" by Du Pont de Nemours and more specifically products of this type designated by codes 5526 and 4056 give excellent results. The same company also produces a thermoplastic rubber "Alcryn TM" that is injectable as thermoplastic material and is also suitable for the above-described application.

It is nevertheless also possible to replace the injection molding operation by applying a mass of raw vulcanizable nitrile rubber followed by vulcanizable.

As to the different peripheral profiles of the opening's peripheries shown in FIGS. 2, 4 and 5, the profile of FIG. 2 seems to give best results when the case member 14 is made of metal. However, depending on the thicknesses and different properties of the material of the case members, any one of the described profiles may also be particularly advantageous.

Figure 7:
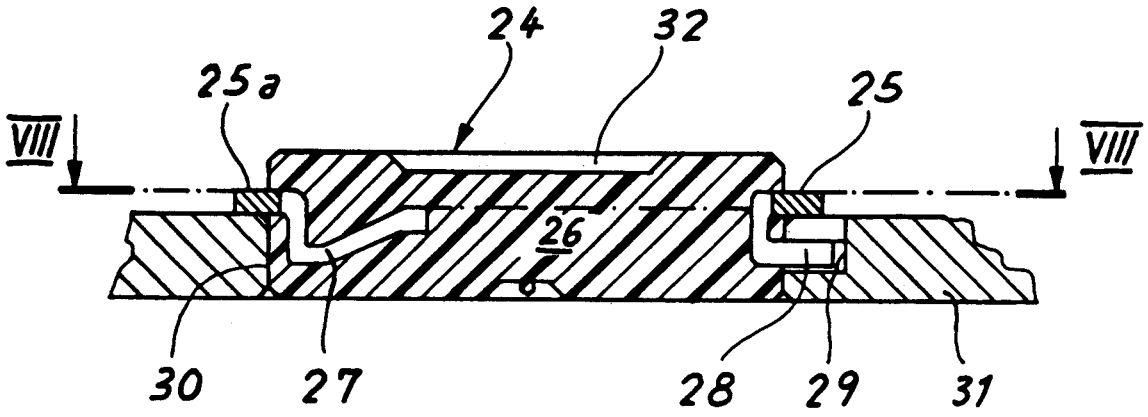
FIGS. 7 and 8 are views, similar to FIGS. 2 and 3, of a fourth embodiment.
Figure 8:
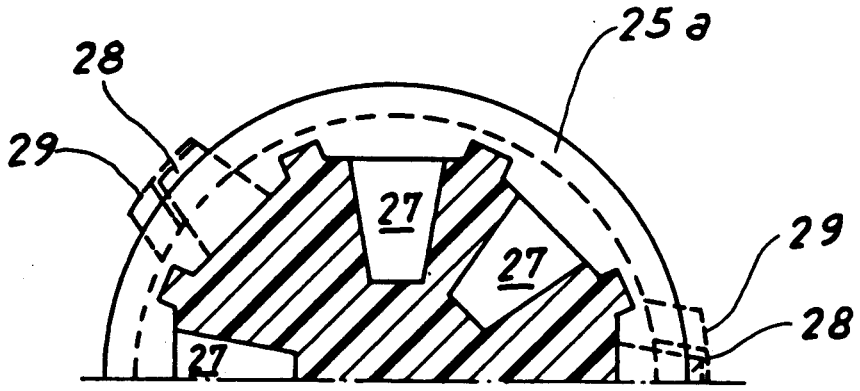

The described cover may also be provided with a bayonet closure device. This is shown in FIGS. 7 and 8. The cover 24 (FIG. 7) is made of an armature 25 on which is anchored, by molding, a packing member 26 of a plastics material of the type mentioned above or having other properties. During an intermediate stage of manufacture of the cover 24, radial arms 27 and 28 with a free inner end are cut in the strip 1 then bent and stamped in two different ways. The arms 27 are bent downwardly then upwardly and inwardly in a manner to extend in V-configuration from the outer ring 25*a* of the armature 25. Two or, possibly, three arms 28 are bent downwardly at right angles then folded outwardly along a plane parallel to the general plane of the armature 25, so as to form claws that engage in suitably-shaped notches 29 located around the periphery of the opening 30 of case member 31. During the molding of the packing member 26 which embeds the arms 27 and partially embeds the arms 28, a diametral groove 32 is formed in the upper face of the packing member to enable it to be rotated during fitting. This movement may also be automatically actuated. If required, the armature could be of such a shape that it reinforces the groove 32.

All of the embodiments described above can be made by automated mass production in which the armature and then the finished cover remain integral with the starting strip until the cover is fitted on the watch, with all of the advantages this entails. However, this is not an essential feature of the invention. For example, the armature may also be fully embedded in the packing member. In this case, at a given stage during production, the armature is separated from the strip and introduced into the injection mold. Fitting of the cover should then include an operation consisting in gripping the finished cover in the mold by manipulation means and delivering it to the final position for engagement in the opening of a watch case member. The armature could in this instance be made of a metal other than stainless steel, for example brass. Generally speaking, the armature could alternatively be of a suitable non-metallic material, for example a rigid plastics material.

Lastly, in all of the embodiments the cover's armature also has a peripheral portion, like the rim *7a* of the cover of FIGS. 2 and 3, which protrudes from the packing member and bears directly against the watch case member about its opening, and the fluid-tightness of closure of this opening is provided by a radial pressure of at least a part of the peripheral surface of the axially-inner portion of the packing member against at least a part of the periphery of the opening.

However, it is possible to envisage embodiments in which the armature would bear on the watch case member indirectly through a layer of resilient material forming part of the packing and in which this layer of resilient material would provide fluid-tightness. This would for example be possible in the previously envisaged case where the armature is completely embedded in the packing member and where the cover is locked in the case-member opening by a bayonet-type arrangement.

What is claimed is:

1. An electronic watch comprising internal parts which define a battery housing, at least one external part having an opening for inserting a battery in said housing, and a removable cover having an inner potion engaged in said opening and an outer portion closing said opening, said cover comprising a rigid armature which is at least partially embedded in a packing member made of a flexible and elastic material; said packing member being molded around at least a portion of said armature so that respective parts of said packing member are on inner and outer sides of said armature and anchor said packing member to said armature; said armature being situated at least partly in said outer portion of the cover and bearing at least indirectly and locally against said external part of the watch around said opening; said external part of the watch and said packing member of the cover having respective annular surfaces in contact with one another; and said packing member of the cover being arranged so that its annular surface is pressed against that of said external part of the watch to provide fluid-tight closure of said opening.

2. A watch according to claim 1, wherein the inner portion of the cover is substantially cylindrical, the annular surface of the packing member is formed by at least a part of the periphery of said inner portion, the annular surface of said external part is formed by at least a part of the periphery of said opening, and the pressure exerted by the annular surface of the packing member against that of said external part also holds the cover in said opening.

3. A watch according to claim 2, wherein said armature comprises a plate situated in the outer portion of the cover and having at least one opening; and wherein said packing member is molded through said at least one opening so that a corresponding part thereof is on each of said inner and outer sides.

4. A watch according to claim 3, wherein said plate is situated solely in the outer portion of the cover and is a thin perforated plate having a plurality of perforations, and wherein a corresponding part of said packing member is molded through each of said perforations.

5. A watch according to claim 3, wherein said plate has a peripheral portion which protrudes from said packing member and bears directly against said external part around said opening.

6. A watch according to claim 2, wherein said armature comprises a crown-shaped planar part situated in the outer portion of the cover and radial arms inside this crown.

7. A watch according to claim 6, wherein said planar part has a peripheral portion which protrudes from said packing member and bears directly against said external part about said opening.

8. A watch according to claim 6, wherein at least some of said radial arms of the armature are bent so as to be located at least partly in the inner portion of the cover.

9. A watch according to claim 1, wherein the inner portion of the cover is substantially cylindrical, and wherein said armature comprises a crown-shaped planar part situated in the outer portion of the cover, and radial arms inside this crown, at least two of these radial arms being bent to have at least a part thereof situated in the inner portion of the cover and free ends that protrude from the packing member in this inner portion to form claws of a bayonet-like arrangement for securing said cover in said opening.

10. A watch according to claim 9, wherein the planar part of said armature has a peripheral portion that protrudes from said packing member and bears directly against said external part about said opening, and the annular surfaces of said packing member and of said external part which provide fluid-tight closure of the said opening are formed by parts of the peripheries of the inner portion of the cover and of said opening.

11. A watch according to claim 9, wherein the planar part of said armature bears against said external part, around said opening, through a layer or resilent material forming part of said packing member, and the contacting surfaces of this layer and of said external part form said annular surfaces that provide fluid-tight closure of said opening.

12. A watch according to claim 1, wherein said armature is metallic.

13. A removable cover for closing an opening for inserting a battery in its housing within an electronic watch comprising internal parts which define said battery housing, and at least one external part which defines said opening, said cover having an inner portion for engaging said opening and an outer portion for closing said opening, and said cover comprising a rigid armature which is at least partially embedded in a packing member made of a flexible and elastic material; said packing member being molded around at least a portion of said armature so that respective parts of said packing member are on inner and outer sides of said armature and anchor said packing member to said armature; said armature being situated at least partly in said outer portion of the cover and positioned to bear at least indirectly and locally against said external part of the watch around said opening; and said packing member of the cover having an annular surface arranged to be pressed against a corresponding annular surface of said external part of the watch to provide fluid-tight closure of said opening.

14. A watch cover according to claim 13, wherein the inner portion of the cover is substantially cylindrical, the annular surface of the packing member is formed by at least a part of the periphery of said inner portion, and the pressure exerted by the annular surface of the packing member against that of said external part is sufficient to hold the cover in said opening when the annular surface of said external part of the watch is formed by at least a part of the periphery of its opening.

15. A watch cover according to claim 14, wherein said armature comprises a plate situated in the outer portion of the cover and having at least one opening; and wherein said packing member is molded through said at least one opening such that a corresponding part thereof is on each of said inner and outer sides.

16. A watch cover according to claim 15, wherein said plate has a peripheral portion which protrudes from said packing member and bears directly against said external part of the watch around its said opening.

17. A watch cover according to claim 14, wherein said armature comprises a crown-shaped planar part situated in the outer portion of the cover and radial arms inside this crown.

18. A watch cover according to claim 22, wherein said planar part has a peripheral portion which protrudes from said packing member and bears directly against said external part of the watch about its said opening.

19. A watch cover according to claim 17, wherein at least some of said radial arms of the armature are bent so as to be located at least partly in the inner portion of the cover.

20. A watch cover according to claim 13, wherein the inner portion of the cover is substantially cylindrical, and wherein said armature comprises a crown-shaped planar part situated in the outer portion of the cover, and radial arms inside this crown, at least two of these radial arms being bent to have at least a part thereof situated in the inner portion of the cover and free ends that protrude from the packing member in this inner portion to form claws of a bayonet-like arrangement for securing said cover in said opening.

21. A watch cover according to claim 20, wherein the planar part of said armature has a peripheral portion that protrudes from said packing member and bears directly against said external part of the watch about its said opening, and the annular surfaces of said packing member and of said external part of the watch are formed by parts of the peripheries of said inner portion of the cover and of said opening.

22. A watch cover according to claim 20, wherein the planar part of said armature bears against said external part of the watch, around its said opening, through a layer or resilient material forming part of said packing member, and the contacting surfaces of this layer and of said external part of the watch form said annular surfaces that provide fluid-tight closure of said opening.

23. A watch cover according to claim 13, wherein said armature is metallic.

24. A method of mass-producing a watch cover according to claim 13, wherein the cover is formed in a series of successive operations including operations or forming the armature and at least one operation for molding the packing member around at least a portion of the armature.

25. A method according to claim 24, wherein the operations of forming the armature are carried out on a continuous strip of rigid material.

26. A method according to claim 25, wherein the operation(s) of molding the packing member are also carried out on said continuous strip.

27. A method according to claim 26, wherein the finished cover is separated from said continuous strip when it is to be placed in the opening of the watch.

28. A method of mass-producing a watch with a cover made according to claim 27, wherein after the cover is separated from said continuous strip it is gripped by a conveyor arm and placed in the opening of the watch.

* * * * *

UNITED STATES PATENT AND TRADEMARK OFFICE

CERTIFICATE OF CORRECTION

PATENT NO. : 5,010,532

DATED : April 23, 1991

INVENTOR(S) : Friedrich Perrot

It is certified that error appears in the above-identified patent and that said Letters Patent is hereby corrected as shown below:

Column 5, line 47, change "potion" to --portion--.

Column 7, line 36, change "22" to --17--.

Signed and Sealed this

Eleventh Day of August, 1992

*Attest:*

DOUGLAS B. COMER

*Attesting Officer*

*Acting Commissioner of Patents and Trademarks*